US005804284A

United States Patent [19]

Lennon et al.

[11] Patent Number: 5,804,284

[45] Date of Patent: Sep. 8, 1998

[54] PAPERBOARD FOR MANUFACTURING SINGLE-LAYER PAPERBOARD TUBE-FORMING PLIES

[75] Inventors: George E. Lennon, Newport, Tenn.; Jerry S. Hall, Hartsville, S.C.; Kevin R. Merritt, Hartsville, S.C.; Henry L. King, Hartsville, S.C.

[73] Assignee: Sonoco Products Company, Inc., Hartsville, S.C.

[21] Appl. No.: 647,035

[22] Filed: May 9, 1996

Related U.S. Application Data

[62] Division of Ser. No. 266,033, Jun. 27, 1994, Pat. No. 5,573,638.

[51] Int. Cl.[6] ..... B32B 3/00; B65D 3/00

[52] U.S. Cl. ..... 428/156; 428/34.2; 428/36.9; 428/167; 428/213; 229/4.5

[58] Field of Search ..... 428/156, 172, 428/154, 213, 212, 537.5, 34.2, 36.9; 229/4.5, 202; 206/830

[56] References Cited

U.S. PATENT DOCUMENTS

| | | | |
|---|---|---|---|
| 90,497 | 5/1869 | Campbell | 162/125 |
| 320,614 | 5/1885 | Beale | 162/123 |
| 701,734 | 6/1902 | Jenks | 162/116 |
| 768,422 | 8/1904 | Case | 162/109 |
| 798,597 | 9/1905 | Case | 162/123 |
| 827,197 | 7/1906 | Walsh | 162/309 |
| 988,253 | 3/1911 | Criswell | 162/117 |
| 988,254 | 3/1911 | Criswell | 162/117 |
| 1,032,107 | 7/1912 | Benedict | 162/309 |
| 1,589,513 | 6/1926 | Clapp | 162/117 |
| 1,788,531 | 1/1931 | Little | 162/301 |
| 1,810,316 | 6/1931 | Lamory | 162/194 |
| 1,881,914 | 10/1932 | Parker | 162/133 |
| 2,225,026 | 12/1940 | Welsh | 156/195 |
| 2,396,694 | 3/1946 | Goodwillie et al. | 162/117 |
| 2,719,464 | 10/1955 | Charles | 162/117 |
| 2,874,618 | 2/1959 | Yang | 428/153 |
| 3,081,213 | 3/1963 | Chinn | 156/192 |
| 3,119,730 | 1/1964 | Johnson | 162/109 |
| 3,274,905 | 9/1966 | Demsey, Jr. et al. | 493/274 |
| 3,304,185 | 2/1967 | Fortney | 426/122 |
| 3,331,549 | 7/1967 | Beasley | 229/202 |
| 3,980,249 | 9/1976 | Cunningham et al. | 138/150 |
| 4,070,235 | 1/1978 | Marshall | 162/116 |
| 4,239,591 | 12/1980 | Blake | 162/109 |
| 4,343,427 | 8/1982 | Sansbury | 229/4.5 |
| 5,045,378 | 9/1991 | Libby | 428/153 |
| 5,084,284 | 1/1992 | McDilda et al. | 426/128 |
| 5,251,809 | 10/1993 | Drummond et al. | 229/202 |

FOREIGN PATENT DOCUMENTS 1078 1/1895 United Kingdom .

*Primary Examiner*—Donald Loney
*Attorney, Agent, or Firm*—Bell Seltzer Intellectual Property Law Group of Alston & Bird LLP

[57] ABSTRACT

The invention provides a continuous paperboard sheet adapted to be slit longitudinally into a plurality of continuous paperboard plies, and to improved paperboard plies for forming single-layer, paperboard tubes. The paperboard sheet has a substantially constant width and includes a plurality of thick longitudinal sections and a plurality of thin longitudinal sections. The thick and thin sections are arranged in alternating relation across the width of the paperboard sheet. The sheet is slit longitudinally along the thin sections to provide a plurality of tube-forming paperboard plies.

13 Claims, 2 Drawing Sheets

PAPERBOARD FOR MANUFACTURING SINGLE-LAYER PAPERBOARD TUBE-FORMING PLIES

This application is a divisional of application Ser. No. 08/266,033, filed Jun. 27, 1994, now U.S. Pat. No. 5,573,638.

FIELD OF THE INVENTION

The invention relates to a continuous paperboard sheet adapted to be slit longitudinally into a plurality of continuous paperboard plies, and to improved paperboard plies for forming single-layer, spirally wound paperboard tubes. The invention also relates to a paperboard manufacturing processes for manufacturing paperboard sheets and plies.

BACKGROUND OF THE INVENTION

Many disposable sheet goods such as toilet tissue, paper towels, gift wrap, aluminum foil and the like, are sold in the form of a roll supported by a tubular paperboard core. Because of the strength required in the paperboard core during the process of winding the disposable sheet goods onto the core, the core is normally formed of at least two radial layers, which in turn, are formed from separate spirally wound paperboard plies. Each of the spirally wound paperboard plies forms a helical seam extending longitudinally along the paperboard tube resulting from abutment of the longitudinally extending edges of the ply along the length of the tube. During the tube manufacturing process, paperboard plies forming radially adjacent layers are wound onto a mandrel so that their respective seams are displaced longitudinally from each other. In other words, the helical seams of the adjacent layers do not overlap.

The paperboard tube making process is conducted by winding the inside paperboard layer onto a stationary mandrel while simultaneously winding one or more exterior paperboard ply over the exterior of the first plies. An adhesive coating is applied to the exterior face of the inside paperboard ply and/or to the interior face of the adjacent exterior paperboard ply. As a result, radially adjacent plies forming separate layers adhere strongly to each other so that the tube can have considerable strength. Although each of the spirally wound layers includes a continuous helical seam, the composite tube formed from several layers does not readily unravel because the seams in adjacent paperboard layers are offset longitudinally from each other as mentioned above, and because of the substantial surface bonding between adjacent layers.

Particularly in those cases where the paperboard tube is used as a core support for a disposable sheet material such as paper towels, toilet tissue, or the like, it is highly desirable to minimize the cost of the paperboard core. This has been achieved in typical commercial practice by minimizing the number of layers of paperboard used to form the core and by minimizing the cost associated with the paperboard forming each of the layers. Accordingly, commercially available cores are preferably formed from only two layers and each layer is formed a relatively inexpensive and weak paperboard, typically of relatively low density and having a high content of recycled material.

As will be apparent, there is a limit to the minimum strength of paperboards that can be used to manufacture paperboard cores. Thus, the cores cannot be made from materials which are so thin and/or weak that they will not form a self-supporting structure upon being wound into helical form because the tube structure must provide support to the sheet material which is wound onto the core. Similarly, the paperboard tube must be formed from at least one layer, and in commercial practice, at least two paperboard layers are used. Two layers are needed to provide the necessary strength to the cores which stems from the bonding and proper alignment of the multiple layers. Moreover, the single continuous helical seam running along the length of paperboard tubes formed of only a single layer are apt to spirally unravel along the seam.

Various attempts have been made to make paperboard tubes from a single layer of paperboard by forming an overlap joint along the helical seam. Thus, attempts have been made to overlap one edge of the ply onto the top of the other edge of the ply as the ply is wound onto the mandrel. However, these attempts have not resulted in production of a commercial paperboard core product when a relatively weak, low basis weight material is used because of various difficulties.

One problem associated with overlapped joints is the uneven exterior and interior surface which normally results. The tube is thicker in the overlapping joint area and thus includes a raised helical seam extending along the exterior of the tube surface. Moreover, a corresponding inside surface of the tube can also be uneven; in other words, the inside surface of such tubes can also include a helical raised region extending from end to end of the tube. These uneven inside surfaces can be problematic for inserting the tube onto a winding mandrel and/or removing the tube from the mandrel. Similarly, the exterior uneven surface can be problematic as it can impact negatively on the appearance on the material wound onto the tube.

In order to eliminate the raised regions associated with overlapped helical joints, paperboard plies having edge portions which are thinner than the middle portion of the ply have been used in an attempt to form an acceptable single ply tube having an overlapped edge seam of a thickness substantially the same as the non-overlapped portions of the tube wall. However, in practice, the costs associated with forming the thinner edges of the paperboard plies can substantially increase the cost of the ply. Thus, the process of forming the thin area on the edges of the paperboard ply must desirably result in an edge having an uniform thickness. Particularly when the paperboard is relatively inexpensive and thus, relatively weak, substantial efforts are required not to overly deform the edges, while at the same time deforming the edges sufficiently to achieve the desired degree of thickness reduction. In practice, edges of plies have been treated to decrease their thickness for the formation of paperboard tubes, by a grinding or compressing process in which the edges of the paperboard ply are ground with an abrasive wheel, or compressed between compressing rollers to decrease its thickness. However, as indicated above, costs associated with such treatments substantially increase the costs of the paperboard plies.

Although such compressed edge plies have been used by the assignee of the present application to form a single layer paperboard tube, the paperboard used in this process has been a relatively high strength, high basis weight paperboard, having a basis weight of about 75 lbs/100 sq ft., and a thickness of about 0.025 inch. These tubes have been used to support relatively expensive gift wrapping papers in which the importance of the appearance of the product justifies a higher cost. However, the costs associated with such paperboard is generally too high for use in the production of core support tubes for toilet paper and paper towels.

As indicated previously, compressing and/or grinding of the edges of paperboard made from relatively low basis weight, relatively low thickness paperboards can be difficult to accomplish with uniformity and can add substantial cost to the paperboard plies. In addition, it has been found in practice that an overlap joint is difficult to achieve in practice when relatively low basis weight, relatively weak paperboard plies are used. When an overlapped joint is formed, substantial pressure must be applied to the tube-forming ply during the spiral winding process. This is necessary so that the overlapping edge will make substantial and uniform contact along the length of the tube. At the same time, the primary portion of the paperboard layer must make substantial contact with the supporting mandrel. If either of these conditions are not met, the paperboard tube will have an uneven, wrinkled appearance and will not be uniformly bonded along the overlapping joint. However, with low basis weight, weak paperboard plies, the tension which must be applied to the plies during the winding process in order to achieve such contact can result in the tearing of the paperboard plies, which in turn, results in shutting down of the tube making process.

Paper of variable thickness has been proposed for uses in which little or no strength is required. For example, U.S. Pat. No. 701,734 to Jenks discusses a process for producing variable thickness paper that can be used as pages in bound books. The method includes compressing portions of a wet paper web with a roller so that the web includes a plurality of longitudinal channels that are thinner than the remaining portions of the web. However, the papers of Jenks would not have the strength of paperboard which is needed for structural uses such as for forming a tubular core for carrying sheet material. U.S. Pat. No. 768,422 to Case discusses a papermaking process which produces multi-ply paper with gradually thinned edges. The individual plies are produced by a series of adjacent and radially aligned cylinders, each of which produces an individual ply. The plies are combined in an overlying fashion to form a multi-ply paper. All of the cylinders have raised longitudinal edge portions that define the width of the ply. The first cylinder in the series produces the narrowest ply. Each successive cylinder produces a slightly wider ply than the preceding cylinder. As the plies are combined, the resulting product is a paper sheet having a thick central portion that thins gradually at its edges.

SUMMARY OF THE INVENTION

The present invention provides continuous paperboard sheets suitable for forming inexpensive paperboard plies which can be readily be used to form single-layer paperboard tubes. The paperboard sheets of the invention can be formed of relatively low basis weight paperboard, but nevertheless can be readily used to provide a plurality of plies for forming single-layer paperboard tubes. The plies formed from the paper, in turn, include substantially uniform areas of reduced thickness along each of their edges. Even in those cases wherein the paperboard plies are of relatively low strength and low basis weight, overlapped joints can readily be formed in a single-layer paperboard tube without tearing or other destruction of the continuous plies.

The continuous paperboard sheets of the invention are elongated sheets having a substantially constant thickness and include a plurality of thick and thin longitudinal sections arranged in alternating relation across the width of the paperboard sheet. Each of the thick and thin sections extend along the length of the sheet substantially parallel to each other and to the edges of the sheet. The width of each of the longitudinally extending sections of the paperboard sheet remains substantially constant along the length of the sheet. The sections of the paperboard sheet having the lesser thickness, have a width substantially less than that of the width of the longitudinally extending thicker sections. The paperboard sheet has a basis weight sufficient to form a self-supporting single layer tube structure. Advantageously, the paperboard sheet has a basis weight greater than about 45 pounds per thousand square feet, more preferably greater than about 50 pounds per thousand square feet. The thickness of the paperboard sheet is advantageously less than about 0.025 inches in the thicker sections, and can have a thickness of about 0.02 inches or less in the thicker sections. Preferably, the paperboard sheet includes at least three or more, more preferably at least about 5 or more longitudinally extending thicker sections separated by longitudinally extending thinner sections. The continuous paperboard sheet is slit longitudinally along the thinner portions to provide elongate paperboard plies suitable for forming single layer paperboard tubes.

In one preferred method embodiment of the invention, the paperboard sheets are formed in a papermaking operation using a plurality of papermaking cylinders operating in series. A continuous paperboard sheet having a relatively large predetermined width is formed on a first of the papermaking cylinders. An array of spaced-apart narrow paperboard strips are formed on a second of the papermaking cylinders. The array of spaced-apart continuous paperboard strips is combined with the wide paperboard sheet by superimposing the array onto the wide paperboard sheet in intimate face-to-face contact therewith to provide a composite sheet having thick longitudinally extending sections and thin longitudinally extending sections. The combined paperboard sheet is then passed through a drying operation. The cylinder to form the array of spaced-apart narrow paperboard strips includes a plurality of permeable circumferential screen portions separated from each other by substantially impermeable circumferential screen portions. The narrow elongate paperboard strips are formed on the permeable portions of the papermaking cylinder in a spaced-apart relation as defined by widths of the impermeable portions of the papermaking cylinder positioned between the permeable cylinder portions. Preferably the paperboard sheet is formed from at least two relatively wide paperboard layers, each of which have a width substantially the same as the overall width of the composite paperboard sheet. More preferably, at least three wide plies are used to form three layers, and at least two spaced apart arrays of longitudinally extending paperboard strips are included in the final product. In such preferred embodiments, the paperboard strips are superimposed in substantial registry onto each other, with, or without, one or more wide paperboard layers being deposited between the superimposed arrays.

In another method embodiment of the invention, a compressing operation is used to define a plurality of thin longitudinally extending portions along the length of the paperboard sheet. The compressing method of the invention can be conducted on paperboard sheet formed from multiple layers of paperboard which include, or do not include, the integrally formed thinner sections extending longitudinally along the sheet as discussed above. In either case, a plurality of spaced apart longitudinal portions of the sheet are compressed subsequent to drying of the paperboard sheet. Preferably, the compressing operation is conducted substantially immediately subsequent to the drying operation. By compressing the thin longitudinal portions of the paperboard sheet, the physical properties of the thin portions, such as strength, pliability and uniformity of width become quite consistent and predictable, even when inexpensive recycled papermaking fibers are used to form the paperboard.

In accordance with another embodiment of the invention, it has been found that substantially improved paperboard tube forming plies are provided by controlling the papermaking operation to provide a moisture content in the final paperboard of greater than about 6% by weight, preferably between about 6% and 9% by weight. This moisture content is greater than the conventional moisture content of paperboard sheet, which normally has a moisture content of about 4% by weight. Particularly with regard to relatively low basis weight paperboard sheets having a substantial content of recycled or similar fiber materials, it has been found that the increased moisture content improves the pliability of the paperboard sheet so that plies formed by slitting the paperboard sheet can more readily be conformed onto a paperboard tube-forming mandrel without requiring the use excessive tension on the paperboard plies. Moreover, compressed portions of the paperboard, which can be relatively brittle under normal conditions, have also been found to conform more readily and thereby provide improved overlapped joints.

The paperboard plies having a moisture content greater than about 6% prepared in accordance with the invention advantageously are rolled into roll form following the slitting operation for transportation, storage, and use in the manufacture of single layer paperboard tubes. In accordance with another preferred embodiment of the invention, the rolled plies are overwrapped with a substantially moisture impermeable wrapper. The substantially moisture impermeable wrapper maintains a relatively high moisture content within the paperboard plies formed according to the invention.

The paperboard tube-forming plies provided according to the invention have thinner longitudinal edges suitable for forming overlapped joints in a wound tube while minimizing wall thickening of the tube at the overlapped joint. The thinned edge sections are substantially uniform in both thickness and in width even when relatively brittle, low basis weight paperboard is used to form the plies. Nevertheless, no separate operation is required to be conducted on the individual plies in order to provide the thinned edges. The paperboard plies prepared according to the invention are capable of forming improved overlapped joints in single ply paperboard tubes so that the adhesion along the continuous, helical joint in the tube is both uniform and substantial. Accordingly, unraveling of the tube is not a substantial problem. Moreover, the improved pliability of the paperboard plies of the invention improves the tube manufacturing process.

BRIEF DESCRIPTION OF THE DRAWINGS

In the drawings, which form a portion of the original disclosure of the invention.

DETAILED DESCRIPTION OF THE PREFERRED EMBODIMENT

Figures 1, 2, 3, 4:
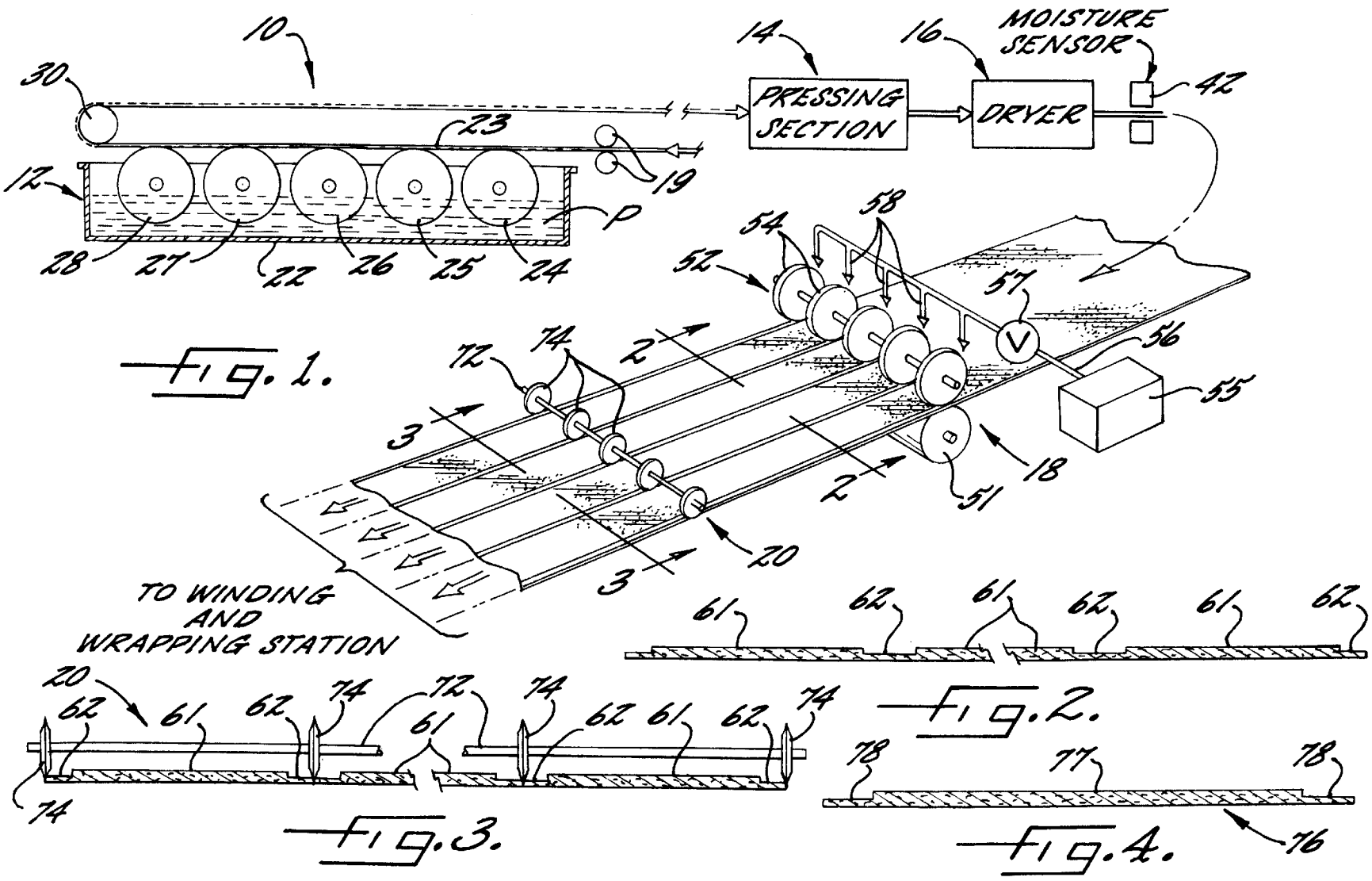
FIG. 1 is a schematic illustration of one preferred paperboard forming operation of the invention for forming a continuous paperboard sheet having a series of continuous, parallel, thick and thin sections arranged in alternating sequence across the width of the sheet, and for slitting the continuous sheet into a plurality of tube forming plies.
FIG. 2 is a transverse sectional view of the continuous paperboard sheet of FIG. 1 showing the thin and thick sections of the sheet following a step for compression of the thin sections.
FIG. 3 is a transverse sectional view of the continuous paperboard sheet of FIG. 1 taken along line 3—3 of FIG. 1 showing a cutting operation for slitting of the thin sections of the full width paperboard sheet using illustrative sharpened cutting wheels.
FIG. 4 is a transverse sectional view of a tube-forming paperboard ply resulting from the slitting operation and which has a thick central portion and thin longitudinal edges.

In the drawings and the following detailed description, preferred embodiments of the invention are described in detail. Although the invention is described with reference to specific preferred embodiments, it will be understood that the invention is not limited to these preferred embodiments. But to the contrary, the invention includes numerous alternatives, modifications and equivalents as will become apparent from the consideration of the foregoing discussion and the following detailed description.

FIG. 1 schematically illustrates one preferred process for forming a continuous paperboard sheet from a plurality of separately formed paperboard layers and for cutting the sheet into a plurality of elongated paperboard tube-forming plies, each having a thick central section and thin longitudinal edges. These paperboard plies can be subsequently formed into single-ply paperboard tubes.

A paperboard processing line, designated generally at 10, comprises a plurality of web formation stations 12 for forming relatively thin paperboard layers, a pressing station 14 for combining the layers into a layered paperboard composite, a drier 16 for drying the layered paperboard composite sheet and converting the layered composite into a unitary sheet, a compression unit 18 for compressing a plurality of continuous longitudinal sections along the paperboard sheet, and a slitting unit 20 for slitting the continuous sheet into a plurality of continuous tube-forming plies.

A multiple cylinder paperboard making station 12 is shown comprising five serially arranged papermaking cylinders 24, 25, 26, 27, 28, a pulp vat 22, and a forming screen 23. As will be apparent to the skilled artisan, multiple cylinder paperboard forming processes and apparatus are well known in the art and can take various forms and arrangements. It will also be apparent that such process and apparatus can advantageously be used in the invention. The pulp vat 22 contains pulp P of any of various well known varieties that can be used to form paperboard and which are also known in the art. Preferably, the pulp P is relatively inexpensive pulp that includes a substantial proportion, e.g., greater than 50 wt. percent (based on solids) of recycled cellulosic materials such as recycled paper, cardboard, paperboard, etc. Typically such pulps are used to provide a relatively low density paperboard.

The vat 22 is sufficiently deep to receive the a portion of each of the cylinders 23, 24, 25, 26, 27, and each of the cylinders reside predominantly within the vat 22, but an upper portion of each cylinder also extends out of the vat 22 in tangential contact with the underside of the forming screen 23. Each of the cylinders includes a porous circumferential screen upon which pulp is deposited and from which moisture laden webs are transferred to the screen 23. The screen 23 is mounted above the vat 22 and the cylinders 24, 25, 26, 27, 28 via a reversing roller 30, which, along with drive rollers 19, drives the screen 23 over the cylinders. Although five papermaking cylinders are illustrated herein, those skilled in this art will appreciate that the number of cylinders used to form multiple-ply paperboard can be varied depending on numerous factors such the desired thickness of the paperboard, the particular pulp stock, the speed of the paperboard operation, etc.

Each of the cylinders 24, 25, 26, 27, 28 forms a relatively thin web from pulp P and continuously transfers the web to the underside of the screen 23. The initial layer formed by the first cylinder 24 is deposited directly onto the screen while the successive cylinders deposit a successive layer onto the previously deposited layer in intimate face-to-face contact therewith. After all five cylinders 24, 25, 26, 27, 28 have formed and transferred pulp layers to form a multiple layered composite web on the forming screen 30, the screen 30 transports the composite web past the roller 30 and to the pressing station 38. At this point the composite web still contains a substantial quantity of water. Preferably the web has a basis weight, based on dry weight of between about 50 and 80 pounds per thousand sq. ft. More preferably a basis weight between about 50 and about 75 lbs/1000 sq. ft.

The webs formed in the conventional papermaking process extend across the full width of each of the multiple cylinders 24–28, and such full width webs are advantageously used in accordance with one embodiment of the invention. In an alternative advantageous embodiment, one or more of the layers forming the multiple layered web can be formed of a layer which is discontinuous in the cross-machine direction, i.e., in the direction across the layered web. The discontinuous layer is formed by a parallel array of substantially coplanar, spaced-apart narrow paperboard webs, each of which extend continuously along the longitudinal or machine direction of the composite web. A composite layered web formed partially of a full width webs, and partially from such a discontinuous layer is shown in FIG. 6.

Figure 5:
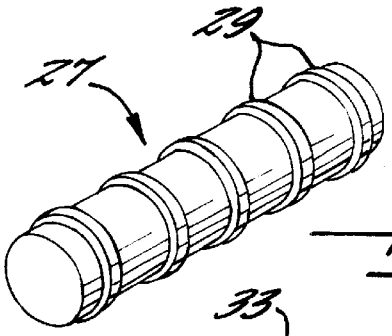
FIG. 5 is a perspective view of a papermaking cylinder that is used in a preferred embodiment of the process illustrated in FIG. 1, and which includes a plurality of deckle straps covering spaced circumferential portions of the paper-forming screen thereof to provide for the formation of an array of a plurality of narrow paperboard-forming plies in the spaced uncovered portions of the screen.
Figure 6:
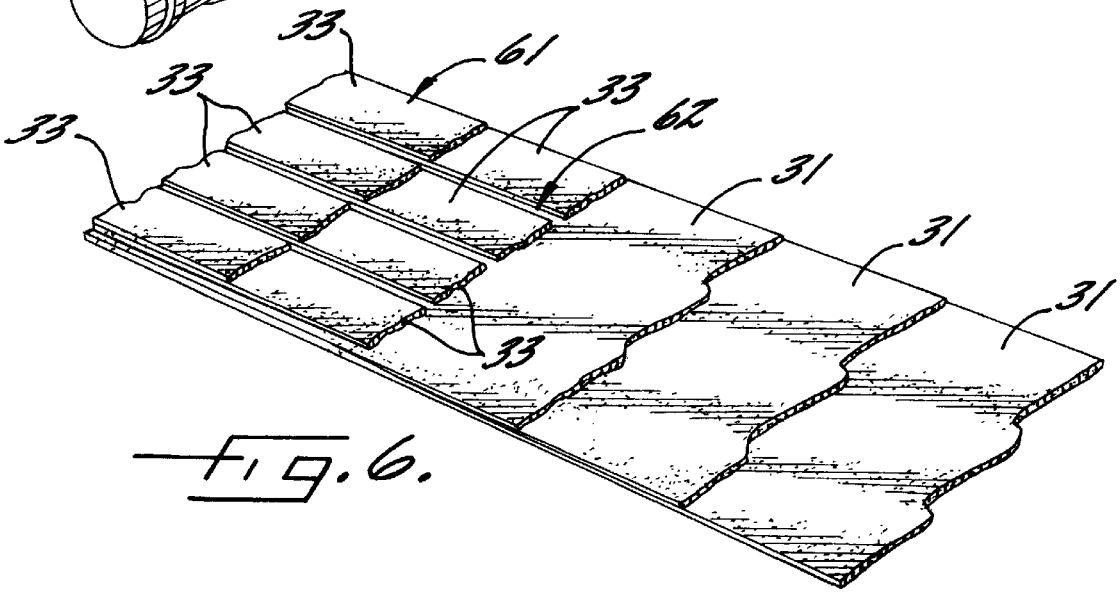
FIG. 6 is partial cutaway perspective view of a continuous, layered paperboard web formed of a plurality of superposed layers arranged in intimate face-to-face contact, including three superposed full width paperboard layers and another layer which is discontinuous in the width direction across the layered web and which is defined by an array of substantially coplanar, spaced-apart narrow paperboard webs, each of which extend continuously along the longitudinal or machine direction of the composite web in parallel relationship.

As illustrated the multiple layered composite web of FIG. 6 has three full width layers 31 and two layers of formed by spaced apart narrow webs 33. As is well known, conventional papermaking cylinders include a circumferential screen, and paper webs are formed substantially across the full width, i.e., in the cross-machine direction along the axis of the cylinders. In accordance with the invention one or more of the cylinders, such as for example the last two cylinders (exemplified by cylinder 27 in FIG. 5), to form a plurality of narrow webs 33. As seen in FIG. 5, the cylinders are modified by attaching a plurality of spaced circumferential deckle straps 29 onto the surface of the screen. Because these deckle straps 29 are moisture-impermeable, pulp is not taken up from the vat 22 on these areas of the cylinder. Because webs are formed only where pulp is taken up, a plurality of narrow plies 33 of a predetermined width (i.e., equal to the distance between the deckle straps) are formed. Deckle straps are known in the art and are readily available in a variety of widths. Normally the deckle straps are used to adjust the width of the papermaking web by covering edge portions of the papermaking screen. The deckle straps are attached to central areas of the screen in accordance with the invention using conventional attachment techniques. Those skilled in this art will appreciate that, although the illustrated deckle straps 29 are preferred, any of various removable or permanent coverings or screen modifications can be used in accord with the invention to provide a plurality of circumferential spaced permeable and impermeable areas on the paperforming screen. Exemplary alternatives include straps of other materials, permanent coatings such as can be formed by coating materials, e.g., paint, and the like.

After being formed on the cylinders, the array of narrow plies 33 are deposited onto the wide plies 31 in intimate face to face contact therewith. The thus formed continuous paperboard sheet includes a series of continuous, parallel, thick and thin sections 61 and 62, respectively, arranged in alternating sequence across the width of the sheet and which each extend along the machine direction of the web. The thick sections 61 correspond to portions of the multi-ply sheet at which the narrow webs 33 are superposed on the full width webs 31, and the thin sections 62 correspond to portions of the multiple layered sheet where the wide plies 31 do not contact a narrow ply 33 and wherein no narrow ply is contained in the layered web. The thick sections 61 are advantageously formed to have a predetermined uniform width that is substantially greater than that of the thin sections 62.

The composite web having inherently formed thick and thin sections as discussed above, or which is of a uniform thickness and formed in the conventional manner from a plurality of full width webs as discussed in connection with FIG. 1, is next passed to a pressing station 38 which is positioned at a location downstream of the pulley 30 for receiving the multiple layered web formed on the screen 23. In the pressing section 38, the multiple layers of the web are pressed together to remove water and thus improve the bonding between the individual ply layers. Although not wishing to be bound by theory, it is generally understood that as pressure is applied to paperboard webs during the formation thereof, hydroxyl groups of the cellulose molecules forming the pulp fibers react with each other to split out water molecules and bond the paper fibers together. Pressure can be applied to the web by any method known by those skilled in this art to be suitable for pressing multiple-ply paperboard webs. At this point, the layers comprising the web become, in large part, indistinguishable from one another and thus constitute a unitary paperboard sheet.

The paperboard sheet which is still supported on the forming screen 23 is continuously withdrawn from the pressing station 32 and is next passed to a heated drying station 16. The drying station 16 applies heat in a controlled manner, to thereby remove water from the web until a desired moisture level is reached. The moisture content can be controlled in various ways as will be apparent, e.g., by controlling both the speed at which the paperboard sheet is passed through the drier and the temperature within the drier, or through the use of a conventional moisture detector and a controller 42. In the latter case the moisture content of the paperboard sheet is sensed by the detector the speed of the forming screen or the temperature within the drier can be adjusted in response thereto by a conventional controller 42. Preferably, the drying conditions are controlled so that the paperboard web exits the drier 16 with a moisture content of between about 6 to 9 percent by weight. As discussed previously, it has been found that paperboard having a moisture content in this range exhibits increased flexibility and is thus less susceptible to bulging and to fracture when wound about a mandrel to form a tube.

The dried paperboard sheet is removed from the drier 16, passed to a compression unit 18, which comprises a backup roller 51 and a pressure roller assembly 52 comprising a plurality of disk-shaped rollers 54. The rollers 54 are oriented and positioned for circumferential contact with the paperboard sheet, and are arranged to apply controlled pressure to the paperboard sheet. The cylindrical backup roller 51 advantageously extends across the width of the web and is positioned directly beneath the roller assembly 52 to contact the underside of the paperboard sheet. In an optional step illustrated in FIG. 1, a tank 55 that is fluidly connected with a conduit 56 via a control valve 57 in order to apply a softening or flexibilizing liquid such as water, or the like, onto the paperboard sheet. The conduit 56 terminates in a plurality of nozzles 58 which are positioned for directing the liquid onto the paperboard sheet.

In operation, the paperboard sheet passes through the nip defined by the backup roller 51 and the disk-shaped rollers 54. Such passage causes the spaced apart regions of the paperboard sheet that contact the rollers 54 to be continuously compressed along the length of the paperboard sheet. The compressed regions are thereby provided with a greater fiber density than the non-compressed regions 61; this is the case with both the constant thickness sheet illustrated in FIG. 1 and the variable thickness sheet illustrated in FIG. 6. It has been discovered that by compressing the paperboard sheet, the thin sections 62 become more pliable, i.e., less brittle, during subsequent use of the sheet such as when narrow plies formed therefrom are wound about a mandrel to form a tube. In addition, compression of the thin longitudinal sections of the paperboard of FIG. 6 has been found to improve the uniformity of width of thin longitudinal sections. In this regard, it was found in practice that inherently formed thin areas of a paperboard sheet as discussed above, can shrink in the widthwise direction during passage through a paper drier, and that the degree of shrinkage can vary in an unpredictable manner depending on factors such as pulp make-up and the like. The compression treatment discussed above has been found to compensate for variations is the width of the compressed sections thereby minimizing or eliminating problems associated with the widthwise shrinkage, of the thin longitudinal sections 62.

After being compressed in the compression unit 18, a paperboard sheet formed by either of the embodiments described hereinabove varies in thickness in the direction across the width of the sheet. The paperboard sheet thus comprises a plurality of elongate thick longitudinal sections 61 alternating with a plurality of elongate thin longitudinal sections 62 as best seen in (FIG. 2). In one preferred embodiment of the invention, the thin longitudinal sections 61 have a thickness in the range of between about 0.013 and 0.018 in. and a width ranging between about 0.25 and 1 in. The thick sections 62 are preferably between about 0.015 and 0.025 inches in thickness, more preferably between 0.016 and 0.020 in. in thickness, and between about 3 and 5 inches in width. Advantageously, the compression is conducted on paperboard of a basis weight of between 50 and 60 lbs. per 1000 sq. ft. to provide a thickness reduction of about 20% to about 25% based on the initial sheet thickness.

Following compression, the paperboard sheet travels to the slitting unit 20, wherein it is cut into a plurality of continuous tube-forming plies (an exemplary ply 76 is shown in FIG. 4). The slitting unit 20 (FIG. 3) can take a wide variety of forms as will be known in the art and is illustrated in a form including an axle 72 that extends across the width of the paperboard sheet and supports a plurality of circular blades 74. Each of the blades 74 is positioned to contact and cut through the paperboard sheet longitudinally along one of the thin longitudinal sections 62 of the sheet. Preferably, the blades 74 are positioned to slit the longitudinal sections 62 at a location on or adjacent to the longitudinal center line thereof so that the thus formed continuous tube-forming plies 76 have thin longitudinal edges 78 that are essentially the same width on each side of the ply. The resulting ply 76 thus has a thick central portion 77 between about 3 and 5 inches wide and between about 0.015 and 0.025 inches thick, and further has a pair of thinned longitudinal edge sections connected to the thick central portion 77. Each of the longitudinal edge portions 78 is preferably between about 0.013 and 0.018 inches in thickness and between about 0.125 and 0.5 inches in width. Because of the manner in which the compressing operation is conducted, the thin edge portions 78 each have faces that are coplanar with each other ane with a face of the thick central portion 77 of the ply. These coplanar faces are shown as the bottom face of the ply in FIG. 4.

Figure 7:
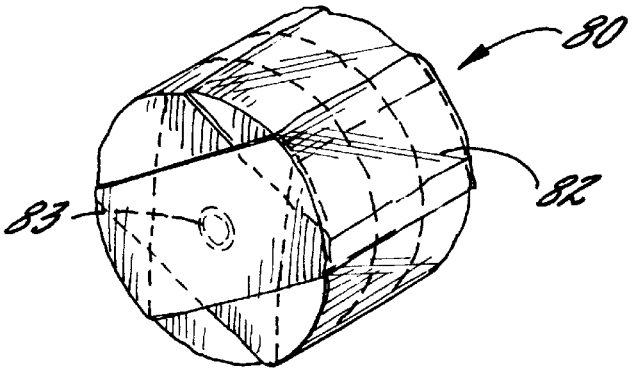
FIG. 7 is a perspective view of a continuous tube-forming paperboard ply of the present invention in roll form overwrapped with a moisture resistant wrapper.

Once the paperboard sheet has been formed into continuous tube-forming plies 76, each ply 76 is wound onto a core 83 to form a paperboard roll 80 as shown in FIG. 7. The roll is advantageously wrapped with sheets of a substantially moisture impermeable material, such as a polymeric film wrapper 82 made of a material such as polyethylene, or are packaged in another moisture impermeable package that maintains the moisture content of the paperboard at between about 6 and 9 percent.

Figure 8:
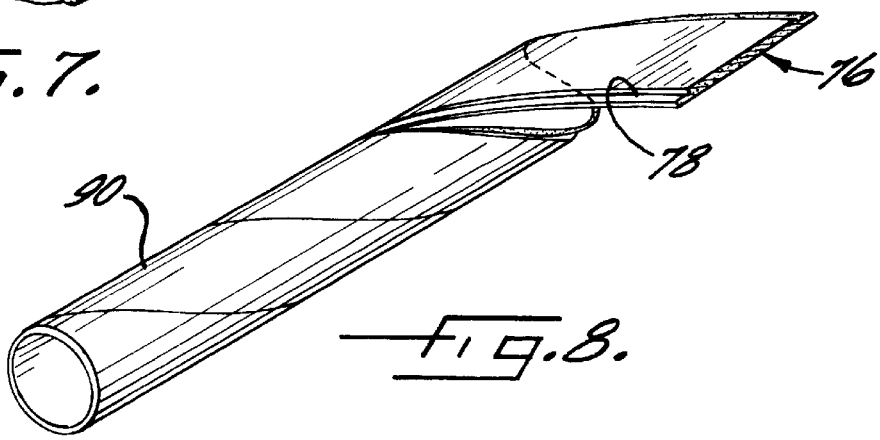
FIG. 8 is a partially exploded perspective view of a tube formed from a continuous paperboard ply of the present invention having a thick central portion and longitudinally thinned edges.

The thus formed paperboard plies 78 may be transported or stored prior to use without substantial moisture loss. The plies are thereafter formed into a spirally wound tube 90 (FIG. 8) that can be used as the core for rolls of other sheet material products, such as toilet tissue, paper towels, gift wrap, aluminum foil, and the like. The tube 90 is formed on a mandrel by winding the ply in a helical fashion about the mandrel so that one of the thinned longitudinal edges 78 overlies the opposite longitudinal edge of the wound ply. The edges 78 are advantageously adhered in this overlying configuration, and the tube thus formed 90 is cut into individual tubes of desired length. Methods for formation of tubes from these paperboard continuous tube-forming plies are disclosed in co-pending U.S. patent application Ser. No. 08/265,999 entitled SINGLE-PLY PAPERBOARD TUBE AND METHOD OF FORMING SAME filed concurrently herewith by George E. Lennon et al.

As shown hereinabove, the present invention can provide paperboard continuous tube-forming plies that are suitable for formation into paperboard tubes. The paperboard has predictable, reliable physical properties such as strength, pliability, and shrinkage that render it suitable for such use. Moreover, the process for forming the paperboard continuous tube-forming plies is simple and can be performed with only slight modifications to existing paperboard manufacturing lines.

The invention has been described in considerable detail by reference to preferred embodiments; however, it will be apparent that numerous variations and modifications can be made without departing from the spirit and scope of the invention as described in the foregoing detailed specification and defined in the appended claims.

That which is claimed is:

1. An elongated paperboard sheet stock for manufacturing continuous tube-forming plies for paperboard tubes, said paperboard sheet comprising:

an elongate continuous paperboard sheet of substantially constant predetermined width including a plurality of thick longitudinal sections of a first predetermined thickness and a plurality of thin longitudinal sections of a thickness less than that of the first thickness, said thick and thin sections being arranged in alternating relation across the width of the paperboard sheet and extending along the length of the sheet substantially parallel to each other and to the edges of the sheet;

each of the thick sections having a substantially constant predetermined width of between about 3.0 and 5.0 inches and less than that of the paperboard sheet, and each of the thin sections having a substantially constant width of between about 0.125 and about 0.5 inches and substantially less than that of the thick sections, each of the thin sections comprising a compressed area extending substantially across the width thereof.

2. The paperboard sheet of claim 1 wherein said sheet has a basis weight sufficient to form self supporting single ply tube structures.

3. The paperboard sheet of claim 1, wherein said thin longitudinal sections have a higher density than said thick longitudinal sections.

4. The paperboard sheet of claim 1, wherein said paperboard has a moisture content of between about 6 and 9 by weight.

5. The paperboard sheet of claim 1, wherein said paperboard sheet has a basis weight of between about 50 and 80 pounds per thousand square feet.

6. The paperboard sheet of claim 1, wherein said thin longitudinal sections have a thickness at least about 20 percent less than that of said thick longitudinal sections.

7. An elongated paperboard sheet stock for manufacturing continuous tube-forming plies for paperboard tubes, said paperboard sheet comprising:

an elongate continuous paperboard sheet of substantially constant predetermined width including a plurality of thick longitudinal sections of a first predetermined thickness and a plurality of thin longitudinal sections of a thickness less than that of the first thickness, said thick and thin sections being arranged in alternating relation across the width of the paperboard sheet and extending along the length of the sheet substantially parallel to each other and to the edges of the sheet;

each of the thick sections having a substantially constant predetermined width less than that of the paperboard sheet and a thickness of between about 0.015 and 0.025 inches and, and each of the thin sections having a substantially constant width substantially less than that of the thick sections and a thickness of between about 0.013 and 0.020 inches and, each of the thin sections comprising a compressed area extending substantially across the width thereof.

8. The paperboard sheet of claim 7, wherein said sheet has a basis weight sufficient to form self supporting single ply tube structures.

9. The paperboard sheet of claim 7, wherein said thin longitudinal sections have a higher density than said thick longitudinal sections.

10. The paperboard sheet of claim 7, wherein said thin longitudinal sections have a width of between about 0.125 and about 0.5 inches, and wherein said thick longitudinal sections have a width of between about 3.0 and 5.0 inches.

11. The paperboard sheet of claim 7, wherein said paperboard has a moisture content of between about 6 and 9 by weight.

12. The paperboard sheet of claim 7, wherein said paperboard sheet has a basis weight of between about 50 and 80 pounds per thousand square feet.

13. The paperboard sheet of claim 7, wherein said thin longitudinal sections have a thickness at least about 20 percent less than that of said thick longitudinal sections.

* * * * *